US009865412B2

(12) United States Patent
Satou et al.

(10) Patent No.: US 9,865,412 B2
(45) Date of Patent: Jan. 9, 2018

(54) PUSH-BUTTON SWITCH DEVICE FOR VEHICLE

(71) Applicants: KABUSHIKI KAISHA HONDA LOCK, Miyazaki-shi, Miyazaki (JP); HONDA MOTOR CO., LTD., Minato-ku, Tokyo (JP)

(72) Inventors: Yuuichi Satou, Miyazaki (JP); Kunihiro Kuroda, Miyazaki (JP); Tsuyoshi Tsuboi, Miyazaki (JP); Eita Yamaki, Wako (JP); Hiroyuki Hazawa, Wako (JP); Tsukasa Kishida, Wako (JP)

(73) Assignees: Kabushiki Kaisha Honda Lock, Miyazaki (JP); Honda Motor Co., Ltd., Tokyo (JP)

( * ) Notice: Subject to any disclaimer, the term of this patent is extended or adjusted under 35 U.S.C. 154(b) by 179 days.

(21) Appl. No.: 14/775,872

(22) PCT Filed: Feb. 25, 2014

(86) PCT No.: PCT/JP2014/054522
§ 371 (c)(1),
(2) Date: Sep. 14, 2015

(87) PCT Pub. No.: WO2014/141874
PCT Pub. Date: Sep. 18, 2014

(65) Prior Publication Data

US 2016/0042889 A1 Feb. 11, 2016

(30) Foreign Application Priority Data

Mar. 15, 2013 (JP) ..... 2013-053123
Mar. 15, 2013 (JP) ..... 2013-053124

(51) Int. Cl.
*H01H 13/14* (2006.01)
*H01H 9/04* (2006.01)
(Continued)

(52) U.S. Cl.
CPC ..... *H01H 13/14* (2013.01); *E05B 81/76* (2013.01); *H01H 9/04* (2013.01); *H01H 13/06* (2013.01);
(Continued)

(58) Field of Classification Search
CPC ..... H01H 13/14; H01H 9/04; E05B 81/76
(Continued)

(56) References Cited

U.S. PATENT DOCUMENTS 5,682,978 A * 11/1997 Kawase ..... H01H 9/04 200/302.1
6,576,854 B2 * 6/2003 Yamanaka ..... E05B 81/76 200/302.1
8,323,051 B2 12/2012 Albers

FOREIGN PATENT DOCUMENTS

JP 2002-175736 A 6/2002
JP 2003-127668 A 5/2003
(Continued)

*Primary Examiner* — Edwin A. Leon
*Assistant Examiner* — Iman Malakooti
(74) *Attorney, Agent, or Firm* — Carrier Blackman & Associates, P.C.; Joseph P. Carrier; Anne G. Sabourin

(57) ABSTRACT

In a push-button switch device for a vehicle including a first case member fixed to a vehicle body or a lid openably and closably mounted on the vehicle body, a second case member mounted on the first case member forming a case together with the first case member, a push-button supported on the case configured for a pushing operation, and a switch housed in and fixed to the case in a state in which waterproofness is ensured while a switching mode thereof is changed in response to a pushing operation of the push-button, the entrance of water into the case is suppressed as
(Continued)

far as possible. A labyrinth passage bent up and down is formed between the first and second case members further inside than an abutment part formed by mutual abutment of at least upper edges among peripheral edges of the first and second case members.

20 Claims, 13 Drawing Sheets

(51) Int. Cl.
*H01H 13/06* (2006.01)
*E05B 81/76* (2014.01)

(52) U.S. Cl.
CPC . *H01H 2009/048* (2013.01); *H01H 2231/026* (2013.01)

(58) Field of Classification Search
USPC ..... 200/293
See application file for complete search history.

(56) References Cited

FOREIGN PATENT DOCUMENTS

| | | | |
|---|---|---|---|
| JP | 2004-047255 | A | 2/2004 |
| JP | 2006-232017 | A | 9/2006 |
| JP | 2008-162372 | A | 7/2008 |
| JP | 2011-514458 | A | 5/2011 |
| JP | 2011-105129 | A | 6/2011 |

* cited by examiner

PUSH-BUTTON SWITCH DEVICE FOR VEHICLE

TECHNICAL FIELD

The present invention relates to a push-button switch device for a vehicle that includes a first case member that is fixed to a vehicle body or a lid openably and closably mounted on the vehicle body, a second case member that is mounted on the first case member so as to form a case together with the first case member, a push-button that is supported on the case so as to be capable of being subjected to a pushing operation, and a switch that is fixed to the case in a state in which waterproofness is ensured while a switching mode thereof is changed in response to a pushing operation of the push-button.

BACKGROUND ART

A push-button switch device for a vehicle in which a switch that changes switching mode in response to a pushing operation of a push-button is housed in and fixed to the interior of a case while ensuring waterproofness, the case being formed from an upper case fixed to a back door of the vehicle and a lower case mounted on the upper case is known from Patent Document 1.

RELATED ART DOCUMENTS

Patent Documents

Patent Document 1: Japanese Patent Application Laid-open No. 2006-232017

SUMMARY OF THE INVENTION

Problems to be Solved by the Invention

However, in the arrangement disclosed in Patent Document 1 above, there is a possibility that water will enter the interior of the case via a part where the upper case and the lower case are joined to form the case, and it is desired to suppress, as far as possible, the entrance of water into the case.

The present invention has been accomplished in light of such circumstances, and it is an object thereof to provide a push-button switch device for a vehicle that can suppress, as far as possible, the entrance of water into a case.

Means for Solving the Problems

In order to attain the above object, according to a first aspect of the present invention, there is provided a push-button switch device for a vehicle, comprising a first case member that is fixed to a vehicle body or a lid openably and closably mounted on the vehicle body, a second case member that is mounted on the first case member so as to form a case together with the first case member, a push-button that is supported on the case so as to be capable of being subjected to a pushing operation, and a switch that is housed in and fixed to an interior of the case in a state in which waterproofness is ensured while a switching mode thereof is changed in response to a pushing operation of the push-button, characterized in that a labyrinth passage that is bent up and down is formed between the first and second case members further inside than an abutment part formed by mutual abutment of at least upper edges among peripheral edges of the first and second case members.

Further, according to a second aspect of the present invention, in addition to the first aspect, part of a waterproof seal held between the first case member and the vehicle body or the lid is disposed so as to overlap the abutment part.

According to a third aspect of the present invention, in addition to the first or second aspect, the first case member integrally comprises a mounting portion mounted on the vehicle body or the lid and an extending portion extending from the mounting portion, the second case member is mounted on the mounting portion so as to cover the mounting portion from above, and an opening for discharging water that has entered between the extending portion and the second case member is formed in the extending portion.

According to a fourth aspect of the present invention, in addition to the third aspect, a guide rib is formed integrally with an upper face of the extending portion so as to guide water to the opening, the guide rib projecting toward the second case member side while surrounding from above the switch in a state in which waterproofness is ensured, and the extending portion being inclined so as to be positioned lower in going away from the mounting portion.

According to a fifth aspect of the present invention, in addition to the fourth aspect, a guide rib peripheral guide groove extending along the guide rib while adjoining the guide rib from above is formed on the upper face of the extending portion.

According to a sixth aspect of the present invention, in addition to any one of the third to fifth aspects, a cover part covering from the outside the opening formed in the extending portion is formed on the second case member.

According to a seventh aspect of the present invention, in addition to any one of the first to sixth aspects, the push-button is supported on the case so as to form a housing chamber in cooperation with the case, the switch being housed in and fixed to the housing chamber, an air vent hole providing communication between an interior of the housing chamber and an exterior thereof is provided in the case, and a canopy part covering the air vent hole at least from above is projectingly provided on an outer face of the case so as to guide water from above the air vent hole to below the air vent hole.

According to an eighth aspect of the present invention, in addition to the seventh aspect, the canopy part has a U-shaped form opening downward so as to surround the air vent hole from above and from the sides.

Moreover, according to a ninth aspect of the present invention, in addition to the eighth aspect, a canopy part peripheral guide groove extending along the canopy part while adjoining the canopy part from above is formed on an outer face of the case.

It should be noted here that a tailgate 15 of an embodiment corresponds to the lid of the present invention.

Effects of the Invention

In accordance with the first aspect of the present invention, since the labyrinth passage is present inwardly of the abutment part of at least the upper edges among peripheral edges of the first and second case members, and the labyrinth passage is bent up and down, even if water enters from the abutment part of the upper edges of the first and second case members, it is possible to suppress, as far as possible, the entrance of water into the case.

Furthermore, in accordance with the second aspect of the present invention, since part of the waterproof seal overlaps the abutment part of the upper edges of the first and second case members, it is possible to suppress more effectively the entrance of water from the abutment part of the upper edges of the first and second case members.

In accordance with the third aspect of the present invention, even if water enters between the extending part, which is integral with the first case member, and the second case member mounted on the extending part so as to cover it from above, it is possible to discharge water from the opening formed in the extending part.

In accordance with the fourth aspect of the present invention, since the guide rib surrounding from above the switch in a state in which its periphery is sealed is integrally formed on the upper face of the extending part so as to project toward the second case member side, and water is guided to the opening by means of the guide rib, even if water enters between the extending part and the second case member, it is possible to guide water to the opening and reliably discharge it.

In accordance with the fifth aspect of the present invention, since the guide rib peripheral guide groove adjoining the guide rib from above extends along the guide rib, even if water enters between the extending part and the second case member, it is possible to more reliably guide water to the opening and discharge it.

In accordance with the sixth aspect of the present invention, since the opening formed in the extending part of the first case member is covered from the outside by the cover part formed on the second case member, it is possible to prevent water from entering the interior of the case from the opening.

In accordance with the seventh aspect of the present invention, since the canopy part covering at least from above the air vent hole provided in the case so as to provide communication between the interior of the housing chamber, in which the switch is housed and fixed, and the exterior guides water from above to below the air vent hole, even if water attached to the case above the air vent hole flows downward, this water is received by the canopy part and guided to below the air vent hole so as to go away from the air vent hole by being guided by means of the canopy part, and it is therefore possible to prevent water from reaching the air vent hole and prevent water from entering the interior of the case from the air vent hole.

In accordance with the eighth aspect of the present invention, since the air vent hole is surrounded from above and the sides by means of the canopy part that has a U-shaped form opening downward, it is possible to further reliably prevent water from reaching the air vent hole.

Furthermore, in accordance with the ninth aspect of the present invention, since the canopy part peripheral guide groove extending along the U-shaped canopy part is formed on the outer face of the case while adjoining the canopy part from above, it is possible to make water that has flowed downward to the canopy part side efficiently flow downward by means of the canopy part peripheral guide groove.

EXPLANATION OF REFERENCE NUMERALS AND SYMBOLS

Figure 1:
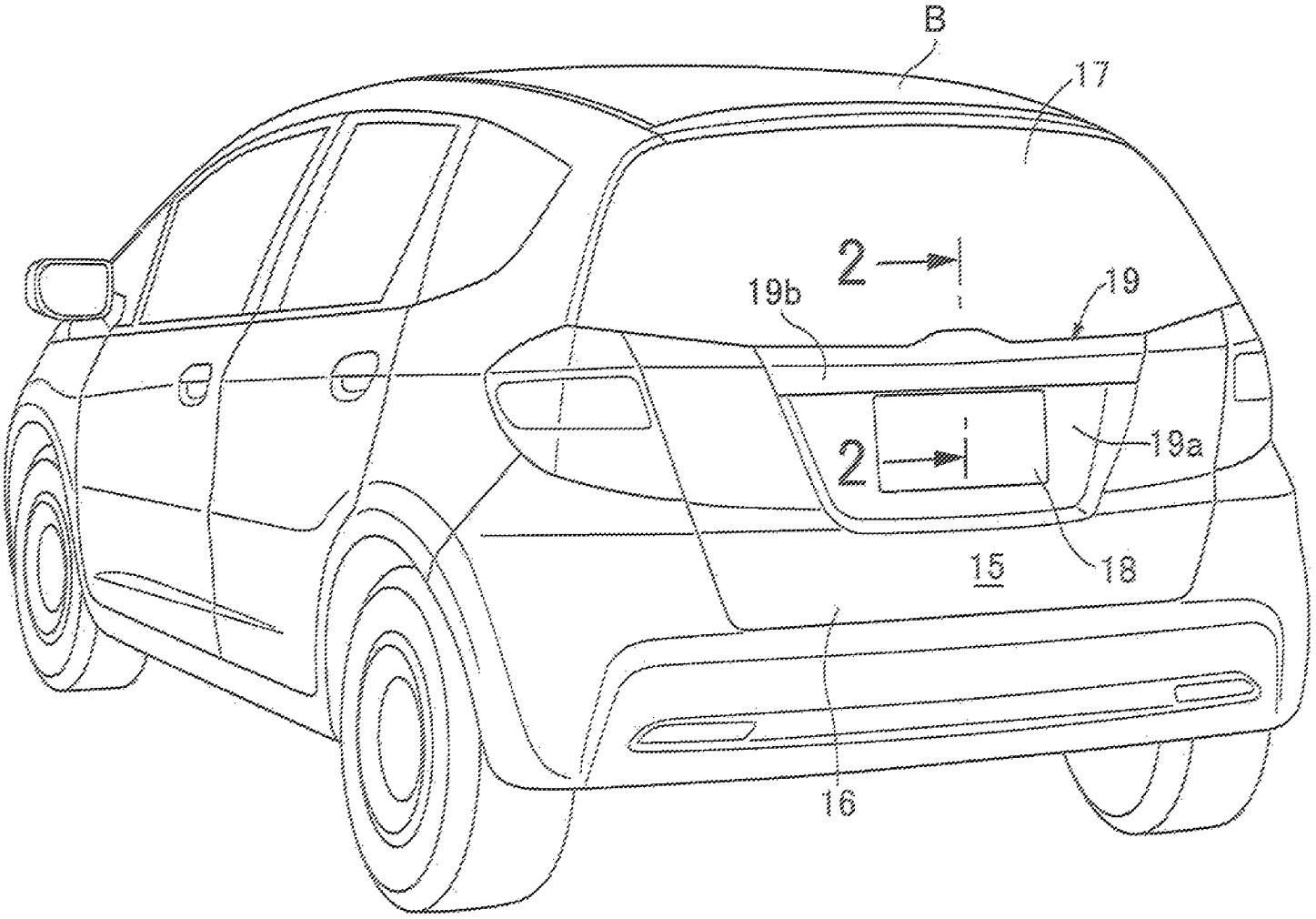
FIG. 1 is a perspective view when a vehicle is viewed from the rear. (first embodiment)

15 Tailgate, which is a lid
20A, 20B Push-button switch device for vehicle
22A, 22B Case
23, 24 Switch
25, 26 Push-button
27A, 27B First case member
27*a* Mounting portion
27*b* Extending portion
28 Second case member
30 Waterproof seal
37 Abutment part
38 Labyrinth passage
72, 73 Housing chamber
77 Air vent hole
83, 89 Canopy part
84 Canopy part peripheral guide groove
85 Opening
86 Guide rib
87 Guide rib peripheral guide groove
88 Cover part
B Vehicle body

MODES FOR CARRYING OUT THE INVENTION

Embodiments of the present invention are explained by reference to the attached drawings.

First Embodiment

A first embodiment of the present invention is explained by reference to FIG. 1 to FIG. 12; first, in FIG. 1, openably and closably mounted on a rear part of a vehicle body B of a passenger vehicle is a tailgate 15, which is a lid, so that it can open upward, and provided in an upper part of the tailgate 15 is a rear glass 17. Fixed to a middle part in the vehicle width direction of the tailgate 15 beneath the rear glass 17 is a decorative cover 19 with a license plate 18 mounted thereon.

Figure 2:
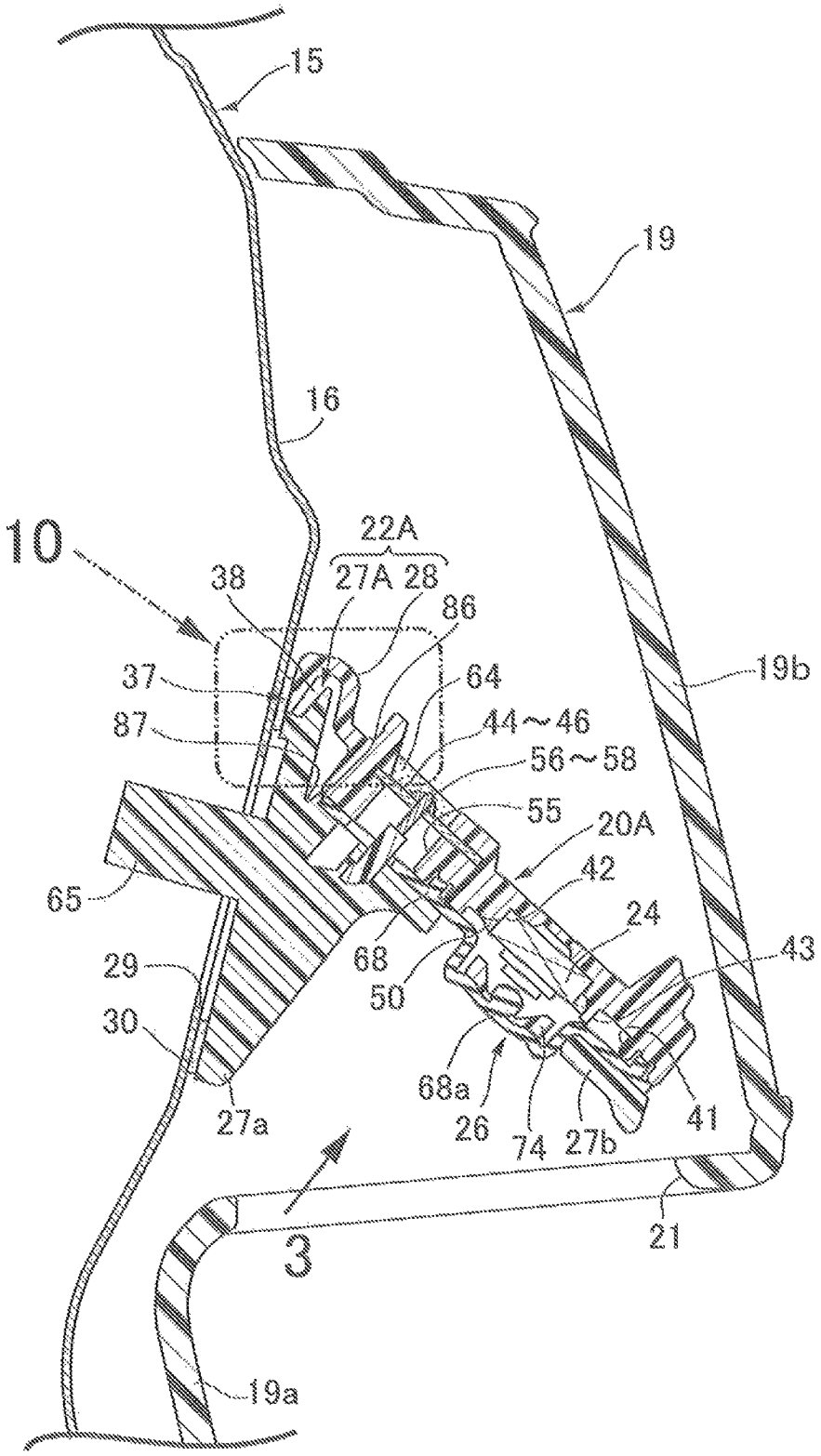
FIG. 2 is an enlarged sectional view along line 2-2 in FIG. 1. (first embodiment)
Figure 3:
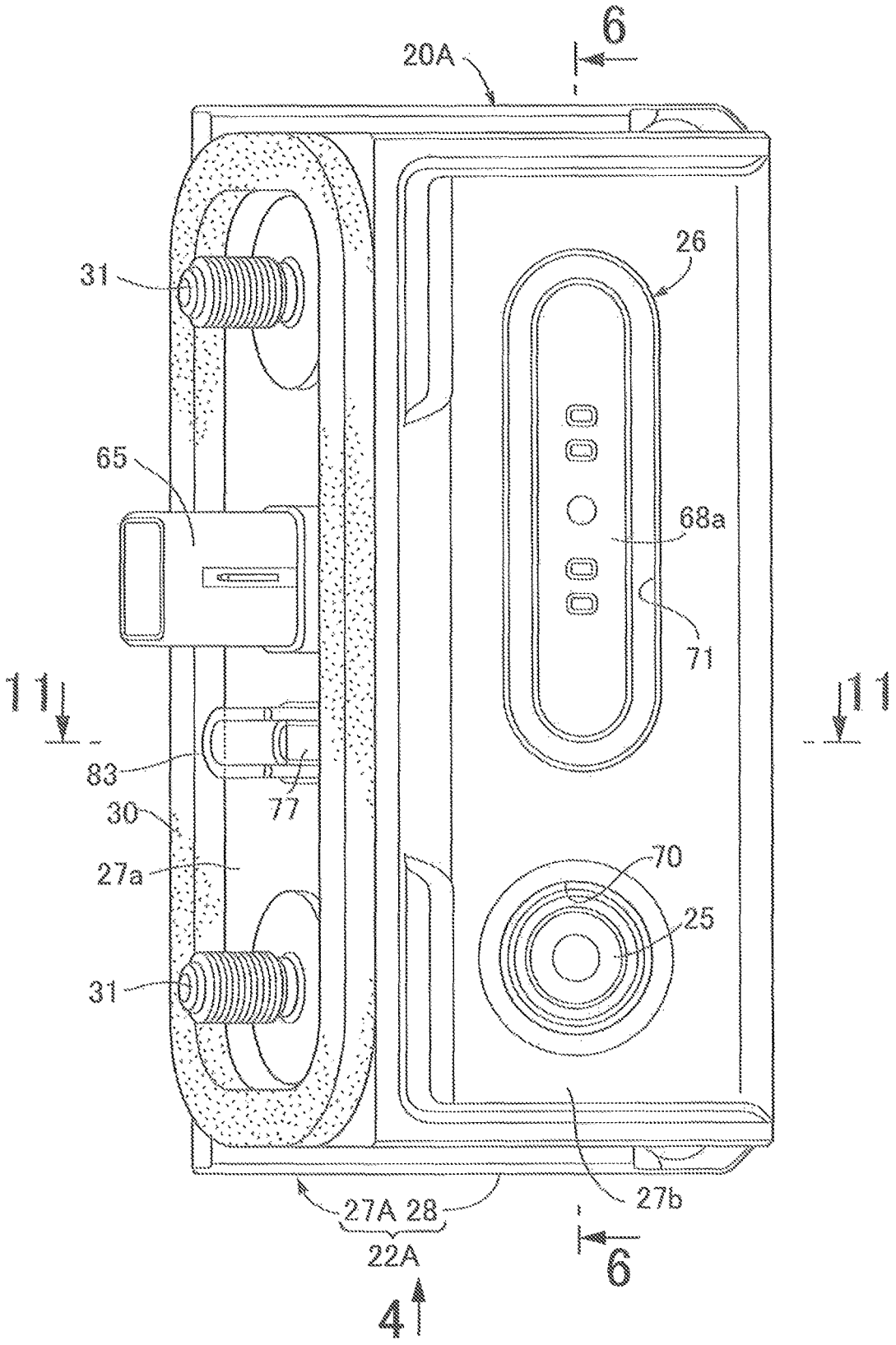
FIG. 3 is a view in the direction of arrow 3 in FIG. 2 in a state in which a tailgate and a decorative cover are omitted. (first embodiment)
Figure 4:
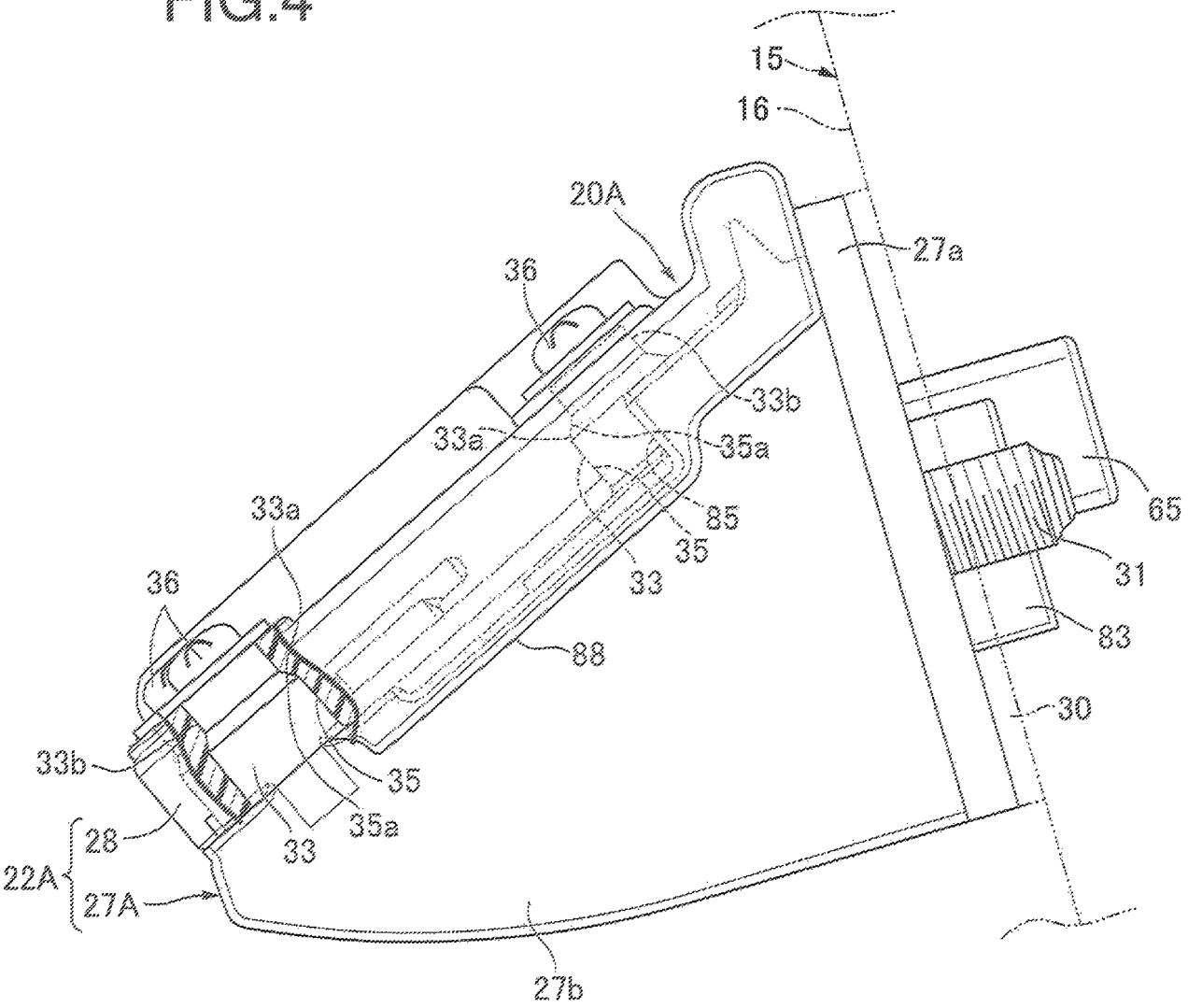
FIG. 4 is a side view from arrow 4 in FIG. 3. (first embodiment)
Figure 5:
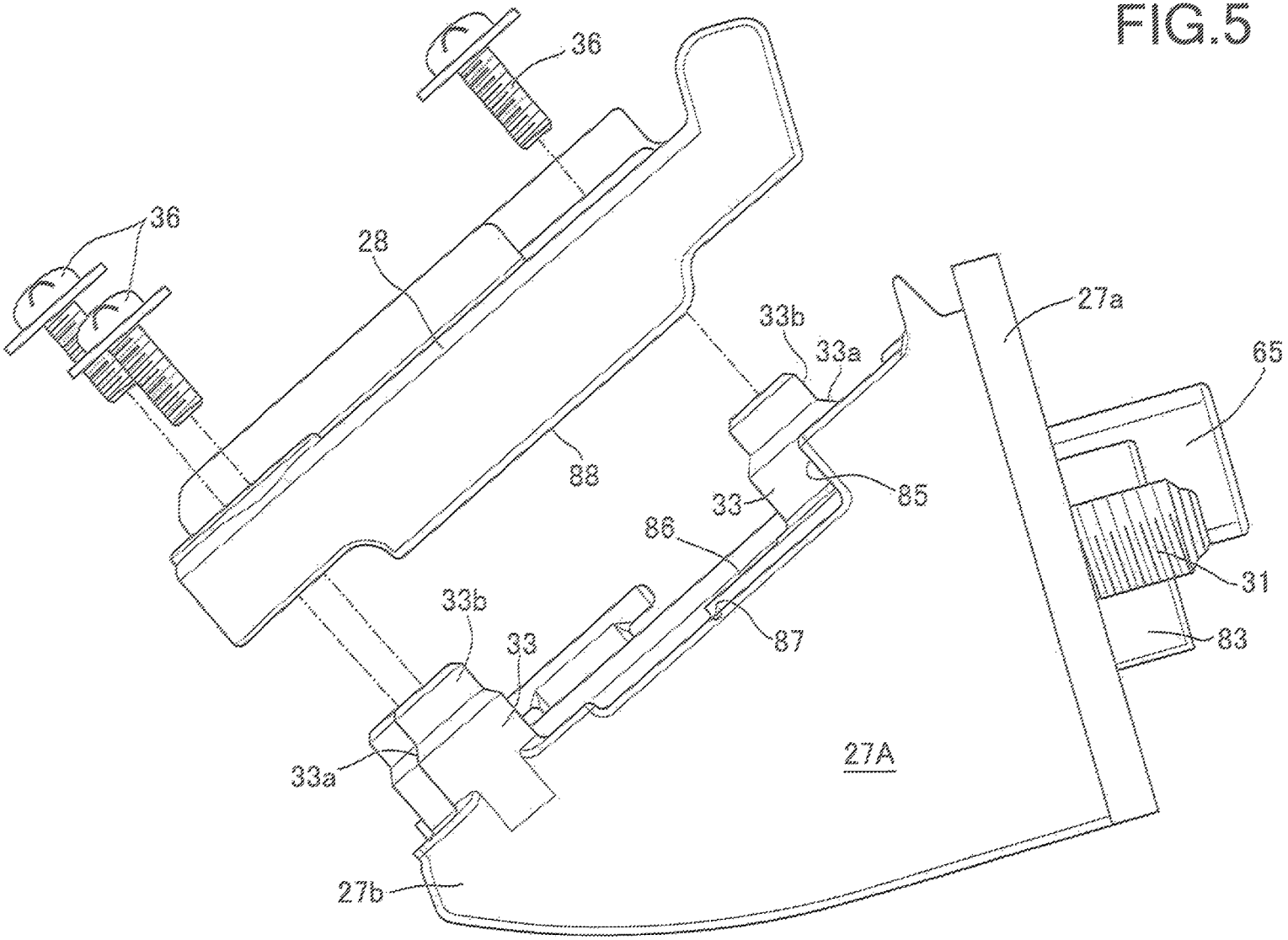
FIG. 5 is a side view, corresponding to FIG. 4, in a state in which a second case member has been detached from a first case member. (first embodiment)
Figure 6:
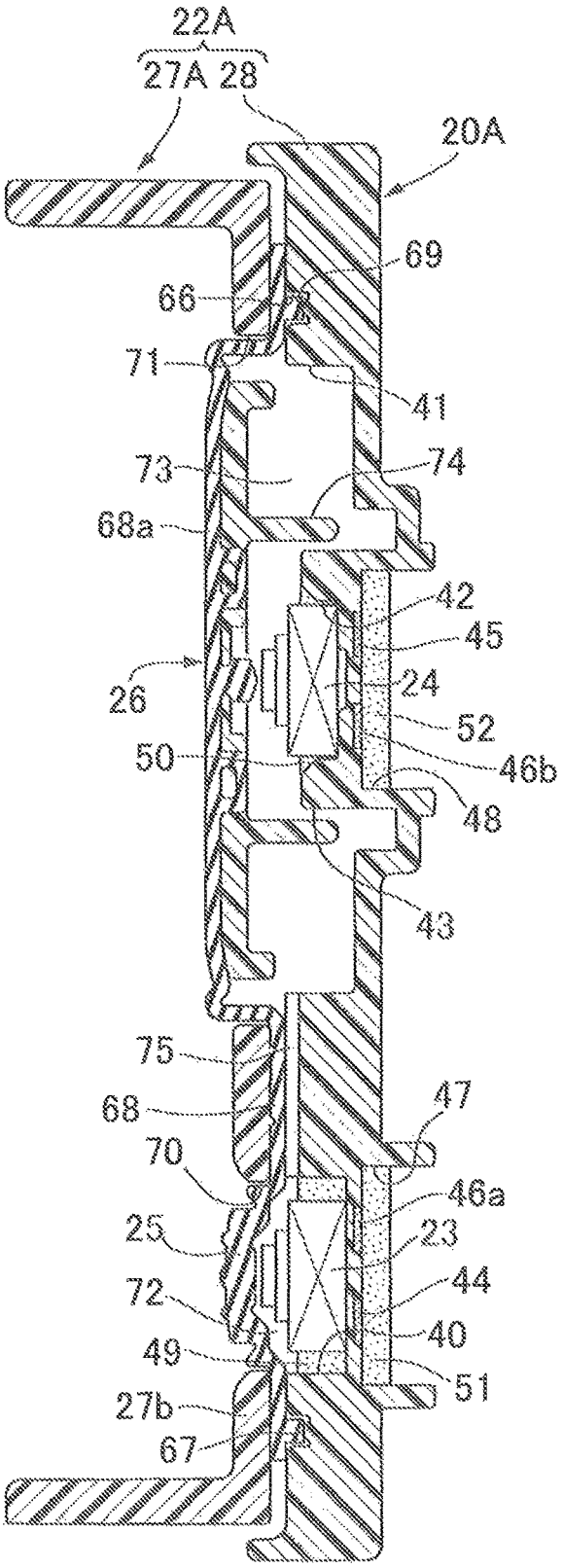
FIG. 6 is a sectional view along line 6-6 in FIG. 3. (first embodiment)
Figure 7:
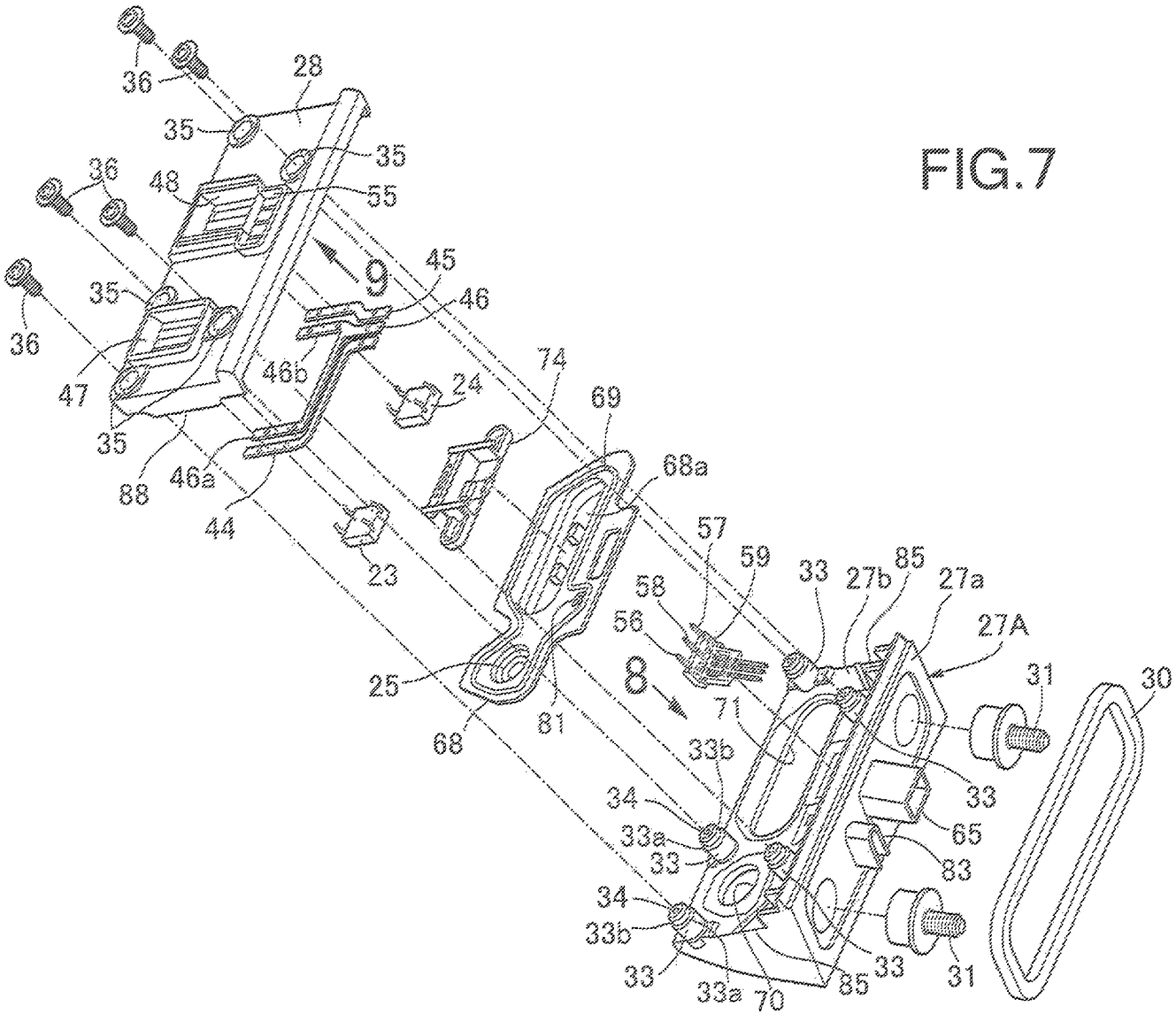
FIG. 7 is an exploded perspective view of a push-button switch device for a vehicle. (first embodiment)

In FIG. 2, the decorative cover 19 integrally has a flat portion 19*a* on which the license plate 18 is mounted, and a bulge portion 19*b* disposed above the flat portion 19*a* so as to bulge from the flat portion 19*a* to the rear of the vehicle, a push-button switch device 20A for a vehicle in accordance with the present invention being mounted on the tailgate 15 so as to be housed within the bulge portion 19*b*. In this embodiment, the push-button switch device 20A for a vehicle can switch between a locked state and an unlocked state for all doors other than the tailgate 15 and can switch between a latched state and an unlatched state of the tailgate 15, an opening 21 for operating the push-button switch device 20A for a vehicle being provided in a bottom part of the bulge portion 19*b*.

Referring in addition to FIG. 3 to FIG. 7, the push-button switch device 20A for a vehicle includes a case 22A fixed to an outer panel 16 of the tailgate 15, first and second switches 23 and 24 fixed to the case 22A, and first and second push-buttons 25 and 26 supported on the case 22A so as to change the switching mode of the first and second switches 23 and 24 by a pushing operation, the first and second switches 23 and 24 being tact switches.

The first switch 23 is for putting all doors other than the tailgate 15 into a locked state; when, in a state in which the first push-button 25 has been pushed and the switching mode of the first switch 23 has been changed, a vehicle user is confirmed to be a legitimate user as a result of bidirectional communication between the vehicle and a portable apparatus possessed by the user, all doors other than the tailgate 15 attain a locked state. The push-button switch device 20A for a vehicle provided on the tailgate 15 includes the first push-button 25 and the first switch 23 for putting all doors other than the tailgate 15 into a locked state so that the inconvenience of going to push a lock switch provided on a driver's seat-side door in order to lock another door after closing the tailgate 15 can be eliminated.

Furthermore, the second switch 24 is for putting all doors other than the tailgate 15 into an unlocked state and putting the tailgate 15 into an unlatched state; when, in a state in which the second push-button 26 has been pushed and the switching mode of the second switch 24 has been changed, a vehicle user is confirmed to be a legitimate user as a result of bidirectional communication between the vehicle and a portable apparatus possessed by the user, all doors other than the tailgate 15 attain an unlocked state and at the same time the tailgate 15 automatically attains an unlatched state by an electric operation, and the tailgate 15 attains an open state.

The case 22A is formed from a first case member 27A, made of a synthetic resin, fixed to the outer panel 16 and a second case member 28, made of a synthetic resin, mounted on the first case member 27A. The first case member 27A integrally includes a mounting portion 27*a* mounted on the outer panel 16, and an extending portion 27*b* extending in an inclined manner from the mounting portion 27*a* so as to be positioned lower in going away from the mounting portion 27*a*, and the second case member 28 is mounted on the extending portion 27*b* so as to cover the extending portion 27*b* from above.

The outer panel 16 is provided with an elongated hole 29 that is long in the vehicle width direction, and a waterproof seal 30 formed into an elliptical shape surrounding the elongated hole 29 is disposed between the outer panel 16 and the mounting portion 27*a* of the first case member 27A. Moreover, a pair of bolts 31 and 31 disposed so as to be spaced in the vehicle width direction are mold bonded to a section, surrounded by the waterproof seal 30, of the mounting portion 27*a*, and screwing nuts (not illustrated) onto the bolts 31 and 31, extending through the outer panel 16, from the inside of the outer panel 16 fixes the mounting portion 27*a* of the first case member 27A to the outer panel 16.

Figure 8:
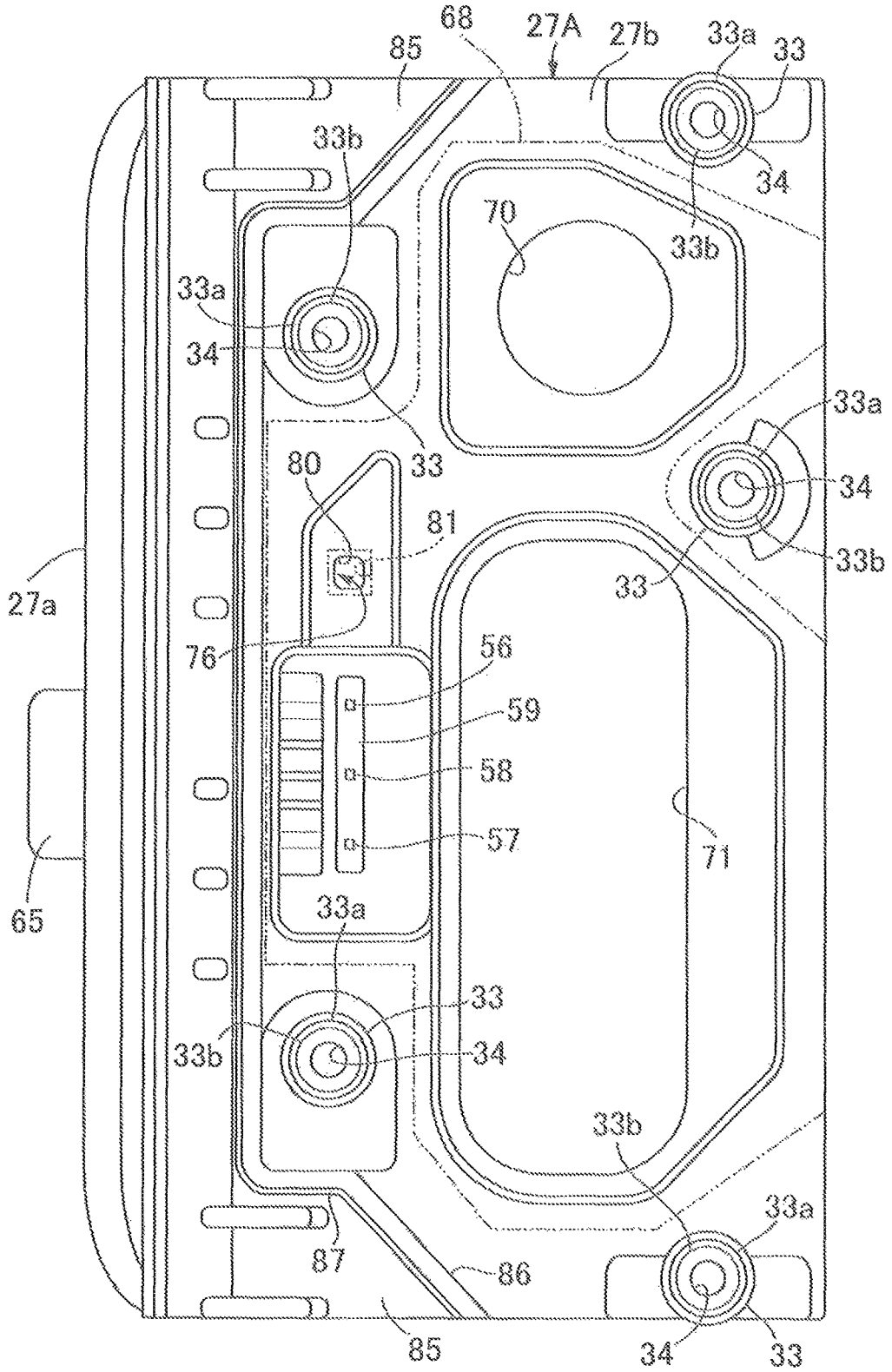
FIG. 8 is an enlarged view from arrow 8 in FIG. 7. (first embodiment)

Referring in addition to FIG. 8, a plurality of, for example five, mounting bosses 33 are integrally and projectingly provided on the extending portion 27*b* of the first case member 27A so as to project toward the second case member 28 side. These mounting bosses 33 are provided with step portions 33*a* that are formed into a tapered shape having a diameter that decreases in going toward the second case member 28 side and that are disposed in an intermediate section in the axial direction, and small diameter shaft portions 33*b* that are coaxially connected to the small diameter ends of the step portions 33*a*. Moreover, the mounting bosses 33 are each provided coaxially with bottomed securing holes 34 having one end opening at the extremities of the small diameter shaft portions 33*b*.

Figure 9:
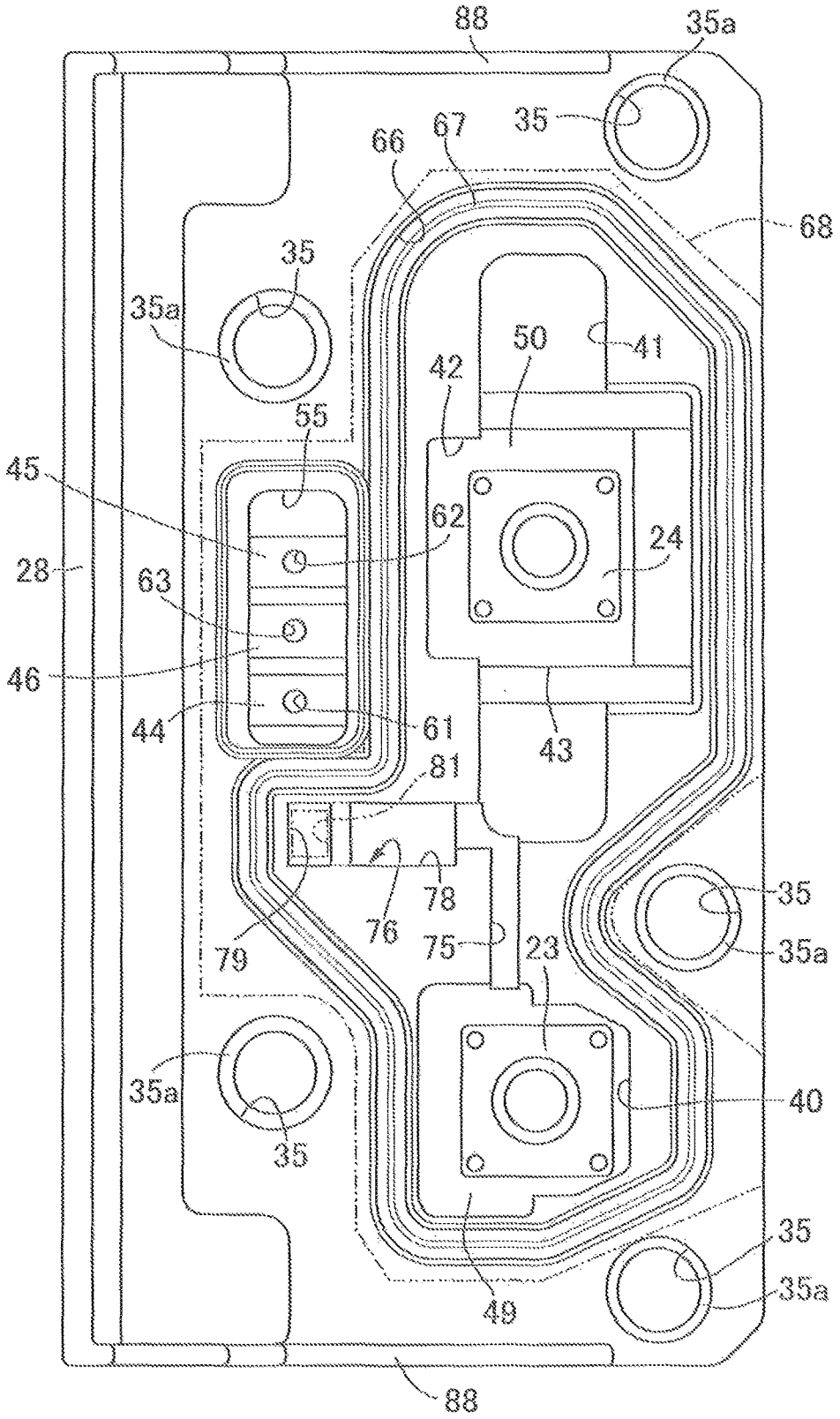
FIG. 9 is an enlarged view from arrow 9 in FIG. 7. (first embodiment)

Referring in addition to FIG. 9, the second case member 28 is provided with insertion holes 35 individually corresponding to the mounting bosses 33, and these insertion holes 35 are formed so that the mounting bosses 33 can be inserted thereinto while having in an intermediate part step-shaped receiving portions 35*a* receiving the step portions 33*a* of the mounting bosses 33. In a state in which the mounting bosses 33 are inserted into the respective insertion holes 35 while the receiving portions 35*a* are receiving the step portions 33*a*, screwing screw members 36 that are inserted into the insertion holes 35 from the side opposite to the extending portion 27*b* of the first case member 27A into the securing holes 34 of the respective mounting bosses 33 mounts the second case member 28 on the extending portion 27*b* of the first case member 27A, the first and second case members 27A and 28 thereby being joined to each other to form the case 22A.

Figure 10:
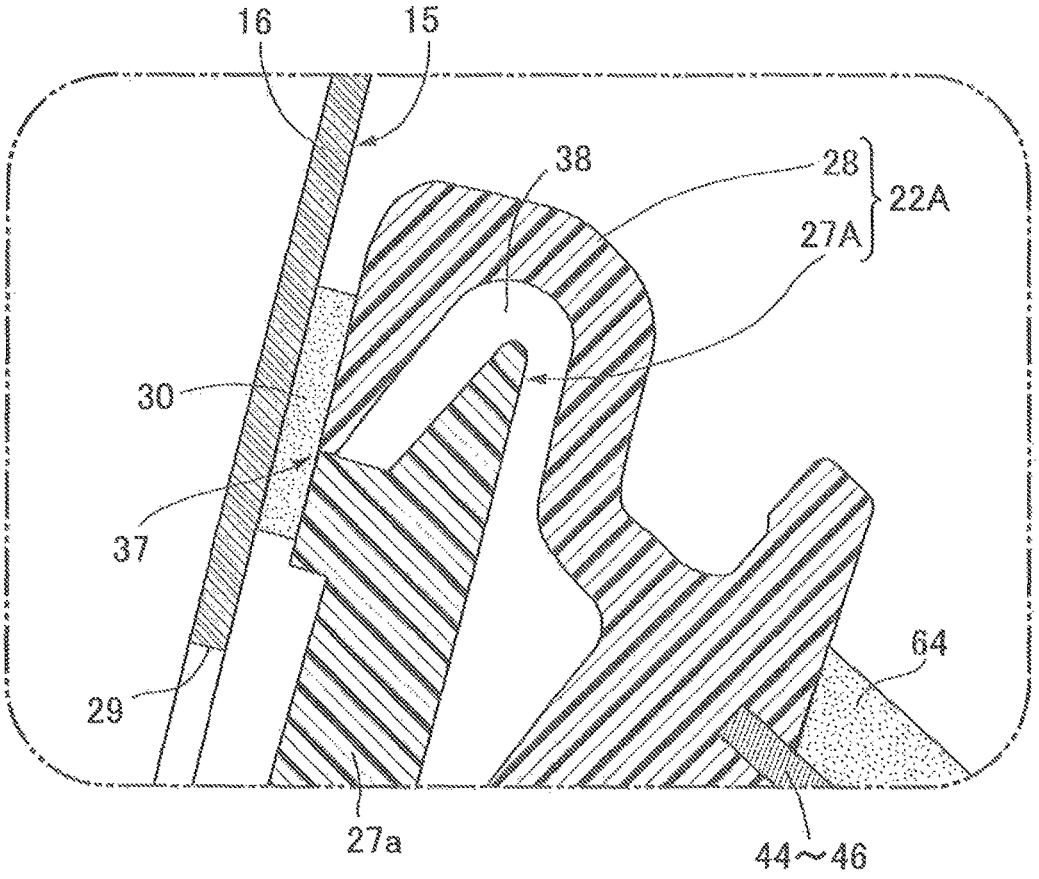
FIG. 10 is an enlarged view of a part shown by arrow 10 in FIG. 2. (first embodiment)

Referring in addition to FIG. 10, in a state in which the second case member 28 is mounted on the extending portion 27*b*, at least upper edges among peripheral edges of the first and second case members 27A and 28, in this embodiment the upper edge of the mounting portion 27*a* of the first case member 27A and the upper edge of the second case member 28, are made to abut against each other to form an abutment part 37. Moreover, a labyrinth passage 38 that is bent up and down is formed between the mounting portion 27*a* of the first case member 27A and the second case member 28 inwardly of the abutment part 37.

Furthermore, part of a waterproof seal 30 sandwiched between the tailgate 15 and the mounting portion 27*a* of the first case member 27A is disposed so as to overlap the abutment part 37.

A first recess 40 and a second recess 41 are formed in the second case member 28 on the side opposite to the extending portion 27*b* of the first case member 27A, the second recess 41 being longer in the vehicle width direction than the first recess 40, and the first switch 23 for putting all doors other than the tailgate 15 into a locked state is housed in the first recess 40.

Furthermore, a projection 43 disposed in a central part of the second recess 41 is provided integrally with the second case member 28 so as to project toward the extending portion 27*b* of the first case member 27A, and a third recess 42 is formed in a central part of the projection 43. Housed in the third recess 42 is the second switch 24 for putting all doors other than the tailgate 15 into an unlocked state and putting the tailgate 15 into an unlatched state.

Mold bonded to the second case member 28 are a first bus bar 44 electrically connected to a positive terminal of the first switch 23, a second bus bar 45 electrically connected to a positive terminal of the second switch 24, and a third bus bar 46 having on one end side first and second branching portions 46*a* and 46*b* branching so as to be connected in common to the negative terminals of the first and second switches 23 and 24.

A first connecting recess 47 corresponding to the first recess 40 and a second connecting recess 48 corresponding to the third recess 42 are formed on a face, on the side opposite to the extending portion 27*b*, of the second case member 28. One end part of the first bus bar 44 and the first branching portion 46*a* of the third bus bar 46 are disposed in the first connecting recess 47 so that part thereof is exposed to the exterior while being arranged side by side. One end part of the second bus bar 45 and the second branching portion 46*b* of the third bus bar 46 are disposed in the second connecting recess 48 so that part thereof is exposed to the exterior while being arranged side by side. Electrically connected to one end part of the first bus bar 44 and the first branching portion 46*a* of the third bus bar 46 is the first switch 23 disposed in the first recess 40, the first switch 23 thereby being fixed to the second case member 28 while being housed within the first recess 40. Furthermore, electrically connected to one end part of the second bus bar 45 and the second branching portion 46*b* of the third bus bar 46 is the second switch 24 disposed in the third recess 42, the second switch 24 thereby being fixed to the second case member 28 while being housed within the third recess 42.

Moreover, a potting resin 49 is charged into the first recess 40 so as to fill in around the periphery of the first switch 23, which is fixed to the second case member 28 while being housed within the first recess 40, and a potting resin 50 is charged into the third recess 42 so as to fill in around the periphery of the second switch 24, which is fixed to the second case member 28 while being housed within the third recess 42. Furthermore, a potting resin 51 is charged into the interior of the first connecting recess 47 in a state in which the first switch 23 is electrically connected to one end part of the first bus bar 44 and the first branching portion 46*a* of the third bus bar 46, and a potting resin 52 is charged into the interior of the second connecting recess 48 in a state in which the second switch 24 is electrically connected to one end part of the second bus bar 45 and the second branching portion 46*b* of the third bus bar 46.

The second case member 28 is provided with a rectangular through hole 55 positioned above the third recess 42 and the second connecting recess 48, and other end parts of the first to third bus bars 44 to 46 are disposed within the through hole 55 side by side. On the other hand, mold bonded to the extending portion 27*b* of the first case member 27A are first to third connecting terminals 56, 57, and 58 individually corresponding to the first to third bus bars 44 to 46. When carrying out mold bonding to the extending portion 27*b*, these first to third connecting terminals 56 to 58 are retained by a holder 59, made of a synthetic resin, as is clearly shown in FIG. 7, and they are mold bonded to the extending portion 27*b* together with the holder 59. Moreover, one end part of each of the first to third connecting terminals 56 to 58 mold bonded to the extending portion 27*b* together with the holder 59 project from the extending portion 27*b* toward the second case member 28 side.

On the other hand, connecting holes 61, 62, and 63 are provided in sections, disposed within the through hole 55, of the other end parts of the first to third bus bars 44 to 46 respectively; joining the first and second case members 27 and 28 to each other inserts one end part of each of the first to third connecting terminals 56 to 58 through the respective one of the connecting holes 61 to 63, and soldering from the side opposite to the extending portion 27*b* within the through hole 55 electrically connects one end part of each of the first to third connecting terminals 56 to 58 to the other end part of the respective one of the first to third bus bars 44 to 46. Furthermore, in a state in which one end part of each of the first to third connecting terminals 56 to 58 is electrically connected to the other end part of the respective one of the first to third bus bars 44 to 46, a potting resin 64 is charged into the through hole 55 from the side opposite to the extending portion 27*b*.

The mounting portion 27*a* of the first case member 27A is provided integrally with a rectangular tubular connector part 65 extending through the elongated hole 29 and projecting toward the interior of the outer panel 16, and the other end parts of the first to third connecting terminals 56 to 58 are disposed within the connector part 65.

Figure 11:
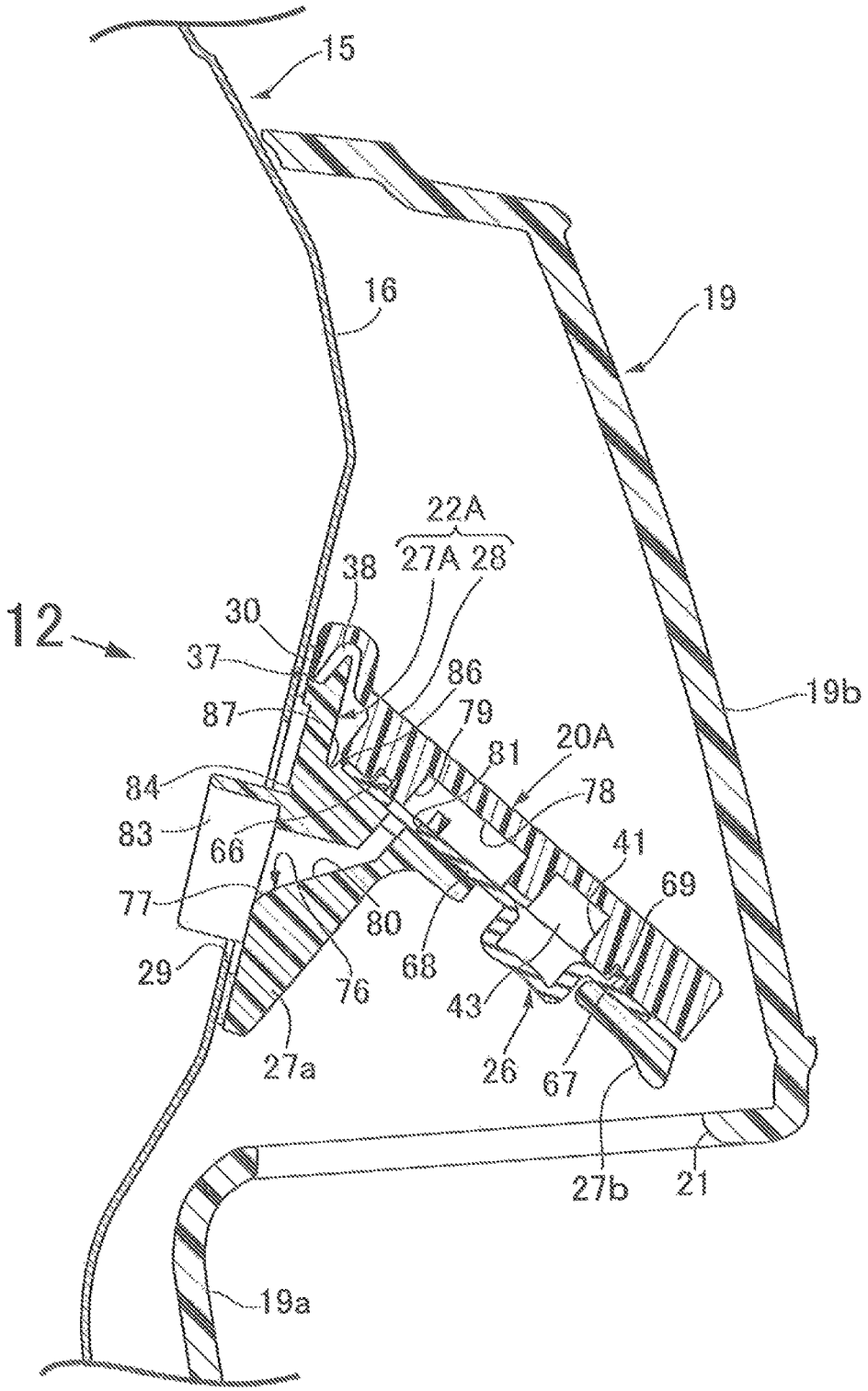
FIG. 11 is a sectional view of the tailgate, the decorative cover, and the push-button switch device for a vehicle along line 11-11 in FIG. 3. (first embodiment)

Referring in addition to FIG. 11, an endless seal groove 66 is formed in the second case member 28 so as to surround the first to third recesses 40 to 42, and an endless rib 67 is formed on a bottom part of the seal groove 66 so as to project from the bottom part. Furthermore, a seal member 68, made of an elastic material such as a rubber, is held between the extending portion 27*b* of the first case member 27A and the second case member 28, and an endless projection 69 is projectingly and integrally provided with this seal member 68, the projection 69 being fitted into the seal groove 66 while having the extremity resiliently abutting against the rib 67.

The extending portion 27*b* of the first case member 27A is provided with a circular first window 70 disposed at a position corresponding to the first recess 40 formed in the second case member 28, and an elongated hole-shaped second window 71 extending in the vehicle width direction at a position corresponding to the second recess 41 formed in the second case member 28.

The first push-button 25 is formed integrally with the seal member 68 so that it can be pushed, the first push-button 25 protruding to the side opposite to the second case member 28 so as to be disposed in the first window 70. A first housing chamber 72 is formed from the first recess 40 of the second case member 28 and the first push-button 25, and the first switch 23 is housed in and fixed to the first housing chamber 72, the switching mode of the first switch 23 being changed by a pushing operation of the first push-button 25.

Furthermore, a bulge portion 68*a* is formed integrally with the seal member 68, the bulge portion 68*a* protruding to the side opposite to the second case member 28 so as to be disposed in the second window 71, the second push-button 26, which can be pushed, is formed from the bulge portion 68*a* and a guide plate 74, made of a synthetic resin, mounted on the inside of the bulge portion 68*a*, a second housing chamber 73 is formed from the second recess 41 of the second case member 28 and the second push-button 26, and the second switch 24 is housed in and fixed to the second housing chamber 73, the switching mode of the second switch 24 being changed by a pushing operation of the second push-button 26.

Mutual communication is provided between the first and second housing chambers 72 and 73 via a communication groove 75 provided in the second case member 28 between the first and second recesses 40 and 41. Formed in the case 22A is a through passage 76 having one end part communicating with the first and second housing chambers 72 and 73 in a state in which they are communicating with each other via the communication groove 75, and provided in the case 22A is an air vent hole 77 providing communication between the other end part of the through passage 76 and the interior of the outer panel 16.

Referring to FIG. 11, the air vent hole 77 is provided in the mounting portion 27*a* of the first case member 27A so as to open from the elongated hole 29 of the outer panel 16 toward the interior of the outer panel 16. The through passage 76 is formed from a groove 78 that is provided in the second case member 28 so as to have one end part communicating with the second housing chamber 73, a bottomed communication hole 79 that is provided in the second case member 28 so as to open on the extending portion 27*b* of the first case member 27A side and have the other end part communicating with the groove 78, a passage hole 80 provided in the extending portion 27*b* and the mounting portion 27*a* of the first case member 27A so as to have one end part opening at a position corresponding to the communication hole 79 and have the other end part communicating with the air vent hole 77, and a through hole 81 provided in the seal member 68 so as to provide communication between the communication hole 79 and the passage hole 80.

Moreover, an end part, on the air vent hole 77 side, of the through passage 76, the passage hole 80 in this embodiment, is formed so as to be positioned lower in going toward the air vent hole 77.

Figure 12:
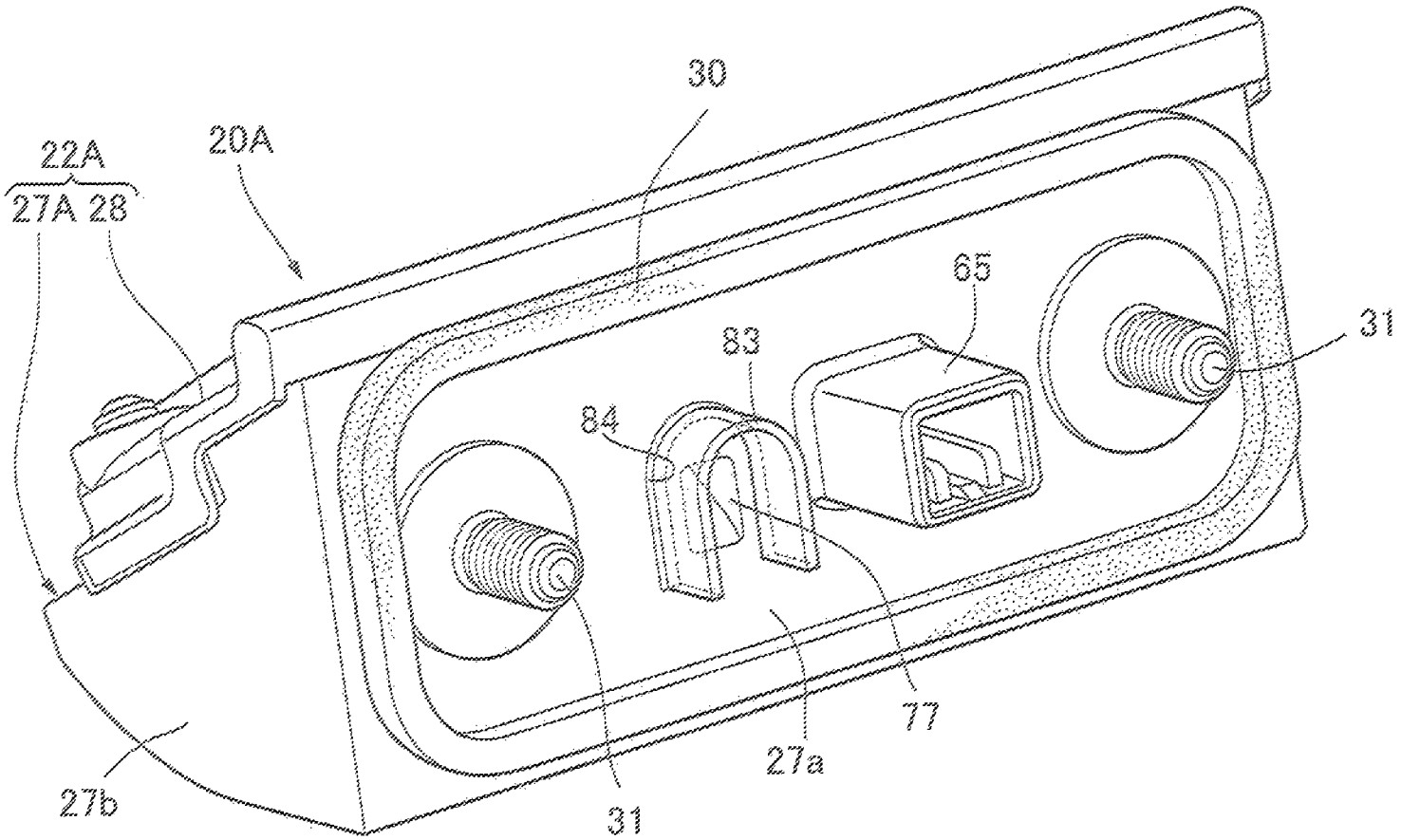
FIG. 12 is a perspective view of the push-button switch device for a vehicle when viewed from the direction of arrow 12 in FIG. 11. (first embodiment)

Referring in addition to FIG. 12, a canopy part 83 covering the air vent hole 77 at least from above is projectingly provided on an outer face of the mounting portion 27*a* of the first case member 27A of the case 22A so as to guide water from above the air vent hole 77 to below the air vent hole 77, and in this embodiment the canopy part 83 has a U-shaped form opening downward so as to surround the air vent hole 77 from above and from the sides.

Moreover, a canopy part peripheral guide groove 84 extending along the canopy part 83 while adjoining the canopy part 83 from above is formed on the outer face of the mounting portion 27*a* of the first case member 27A of the case 22A.

Openings 85 and 85 are formed in opposite sides, in the vehicle width direction, of the extending portion 27*b* of the first case member 27A in order to discharge water that has entered between the extending portion 27*b* and the second case member 28, and a guide rib 86 is formed integrally with the upper face of the extending portion 27*b* so as to guide water to the openings 85, the guide rib 86 projecting toward the second case member 28 side while surrounding from above the first and second switches 23 and 24, that is, the seal groove 66, in a state in which waterproofness is ensured.

Furthermore, a guide rib peripheral guide groove 87 extending along the guide rib 86 while adjoining the guide rib 86 from above is formed on an upper face of the extending portion 27*b*.

Moreover, cover parts 88 are formed on opposite sides, in the vehicle width direction, of the second case member 28, the cover parts 88 covering the openings 85 formed in opposite sides of the extending portion 27*b* from the outside.

The operation of this embodiment is now explained; since the first and second switches 23 and 24 are housed in and fixed to the interiors of the first and second housing chambers 72 and 73 formed in the case 22A fixed to the outer panel 16 of the tailgate 15, the air vent hole 77 providing communication between the housing chambers 72 and 73 and the exterior is provided in the mounting portion 27*a* of the first case member 27A of the case 22A, and the canopy part 83, which covers the air vent hole 77 at least from above, is projectingly provided on the outer face of the mounting portion 27*a* so as to guide water from above the air vent hole 77 to below the air vent hole 77, even if water attached to the case 22A above the air vent hole 77 flows downward, this water is received by the canopy part 83 and guided by the canopy part 83 to below the air vent hole 77 so as to go away from the air vent hole 77, and it is therefore possible to prevent water from reaching the air vent hole 77 and prevent water from entering the interior of the case 22A from the air vent hole 77.

Furthermore, since the canopy part 83 has a U-shaped form opening downward so as to surround the air vent hole 77 from above and from the sides, it is possible to more reliably prevent water from reaching the air vent hole 77.

Moreover, since the canopy part peripheral guide groove 84 extending along the canopy part 83 while adjoining the canopy part 83 from above is formed on the outer face of the mounting portion 27*a* of the first case member 27A of the case 22A, it is possible to make water that has flowed down toward the canopy part 83 side flow down efficiently by means of the canopy part peripheral guide groove 84.

Since the labyrinth passage 38 that is bent up and down is formed between the first and second case members 27A and 28 inwardly of the abutment part 37, which is formed by abutment of at least the upper edges, among the peripheral edges, of the first and second case members 27A and 28 forming the case 22A in cooperation, even if water were to enter from the abutment part 37 of the upper edges of the first and second case members 27A and 28, it is possible to suppress, as far as possible, the entrance of water into the case 22A.

Furthermore, since part of the waterproof seal 30 held between the outer panel 16 of the tailgate 15 and the mounting portion 27*a* of the first case member 27A is disposed so as to overlap the abutment part 37, it is possible to suppress more effectively the entrance of water from the abutment part 37 of the upper edges of the first and second case members 27A and 28.

Moreover, since the first case member 27A integrally includes the mounting portion 27*a* mounted on the outer panel 16 of the tailgate 15 and the extending portion 27*b* extending from the mounting portion 27*a*, the second case member 28 is mounted on the mounting portion 27*a* so as to cover it from above, and the openings 85 for discharging water that has entered between the extending portion 27*b* and the second case member 28 are formed in the extending portion 27*b*, even if water enters between the extending portion 27*b* of the first case member 27A and the second case member 28, water can be discharged from the openings 85 formed in the extending portion 27*b*.

Furthermore, since the extending portion 27*b* is inclined so that it is positioned lower in going away from the mounting portion 27*a*, and the guide rib 86, which projects toward the second case member 28 side so as to surround from above the first and second tact switches 23 and 24 in a state in which waterproofness is ensured, is formed integrally with the upper face of the extending portion 27*b* so as to guide water to the openings 85, even if water enters between the extending portion 27*b* and the second case member 28, this water can be guided to the openings 85 and reliably discharged.

Moreover, since the guide rib peripheral guide groove 87, which extends along the guide rib 86 while adjoining the guide rib 86 from above, is formed on the upper face of the extending portion 27*b*, even if water enters between the extending portion 27*b* and the second case member 28, this water can be more reliably guided to the openings 85 and discharged.

Furthermore, since the cover parts 88 covering from the outside the openings 85 formed in the extending portion 27*b* are formed on the second case member 28, it is possible to prevent water from entering the interior of the case 22A from the openings 85.

Second Embodiment

Figure 13:
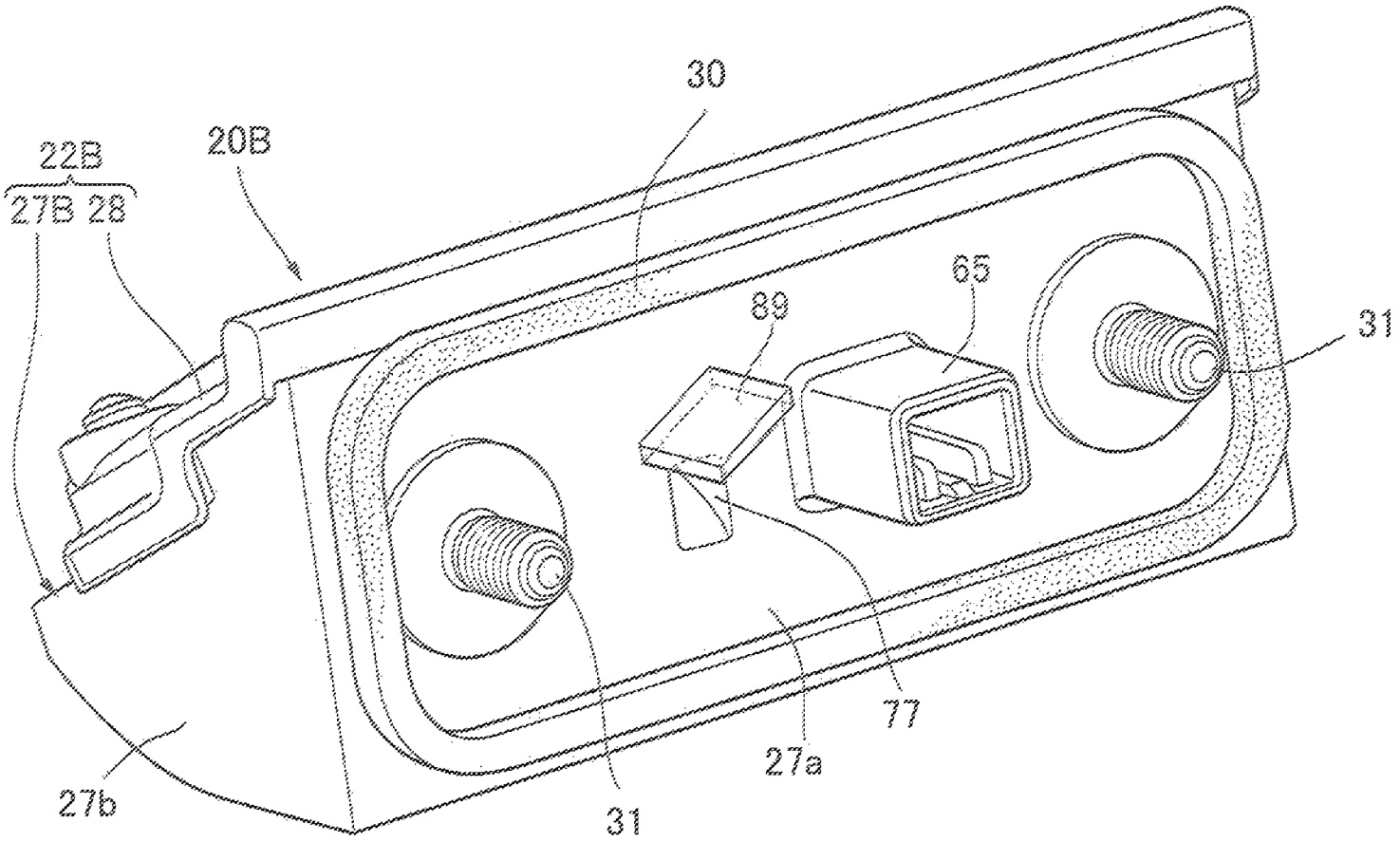
FIG. 13 is a perspective view, corresponding to FIG. 12, of a second embodiment. (second embodiment)

FIG. 13 shows a second embodiment of the present invention; a canopy part 89 covering an air vent hole 77 from above is projectingly provided on an outer face of a mounting portion 27*a* of a first case member 27B forming, together with a second case member 28, a case 22B of a push-button device 20B for a vehicle, and this canopy part 89 is formed in an inclined manner so as to be positioned lower in going toward one side in the vehicle width direction.

In accordance with this second embodiment also, since water from above the air vent hole 77 is guided by means of the canopy part 89 to below the air vent hole 77, even if water attached to the case 22B above the air vent hole 77 flows downward, this water is received by the canopy part 89 and is guided by means of the canopy part 89 to below the air vent hole 77 so as to go away from the air vent hole 77, thereby making it possible to prevent water from reaching the air vent hole 77 and prevent water from entering the interior of the case 22B from the air vent hole 77.

Embodiments of the present invention are explained above, but the present invention is not limited to the embodiments described above and may be modified in a variety of ways as long as the modifications do not depart from the spirit and scope thereof.

The invention claimed is:

1. A push-button switch device for a vehicle, comprising a first case member that is fixed to a vehicle body or a lid openably and closably mounted on the vehicle body, a second case member that is mounted on the first case member so as to form a case together with the first case member, a push-button that is supported on the case so as to be capable of being subjected to a pushing operation, and a switch that is housed in and fixed to an interior of the case in a state in which waterproofness is ensured while a switching mode thereof is changed in response to a pushing operation of the push-button, wherein a labyrinth passage that is bent up and down is formed by the first and second case members, between the mounting portion of the first case member and second case members, inwardly of an abutment part formed by mutual abutment of at least upper peripheral edges of the first and second case members, suppressing entry of water into the case formed by the first and second case members.

2. The push-button switch device for a vehicle according to claim 1, wherein part of a waterproof seal held between the first case member and the vehicle body or the lid is disposed so as to overlap the abutment part.

3. The push-button switch device for a vehicle according to claim 1, wherein the first case member integrally comprises a mounting portion mounted on the vehicle body or the lid and an extending portion extending from the mounting portion, the second case member is mounted on the mounting portion so as to cover the mounting portion from above, and an opening for discharging water that has entered between the extending portion and the second case member is formed in the extending portion.

4. The push-button switch device for a vehicle according to claim 3, wherein a guide rib is formed integrally with an upper face of the extending portion so as to guide water to the opening, the guide rib projecting toward the second case member side while surrounding from above the switch in a state in which waterproofness is ensured, and the extending portion being inclined so as to be positioned lower in going away from the mounting portion.

5. The push-button switch device for a vehicle according to claim 4, wherein a guide rib peripheral guide groove extending along the guide rib while adjoining the guide rib from above is formed on the upper face of the extending portion.

6. The push-button switch device for a vehicle according to claim 3, wherein a cover part covering from the outside the opening formed in the extending portion is formed on the second case member.

7. The push-button switch device for a vehicle according to claim 1, wherein the push-button is supported on the case so as to form a housing chamber in cooperation with the case, the switch being housed in and fixed to the housing chamber, an air vent hole providing communication between an interior of the housing chamber and an exterior thereof is provided in the case, and a canopy part covering the air vent hole at least from above is projectingly provided on an outer face of the case so as to guide water from above the air vent hole to below the air vent hole.

8. The push-button switch device for a vehicle according to claim 7, wherein the canopy part has a U-shaped form opening downward so as to surround the air vent hole from above and from the sides.

9. The push-button switch device for a vehicle according to claim 8, wherein a canopy part peripheral guide groove extending along the canopy part while adjoining the canopy part from above is formed on an outer face of the case.

10. The push-button switch device for a vehicle according to claim 2, wherein the first case member integrally comprises a mounting portion mounted on the vehicle body or the lid and an extending portion extending from the mounting portion, the second case member is mounted on the mounting portion so as to cover the mounting portion from above, and an opening for discharging water that has entered between the extending portion and the second case member is formed in the extending portion.

11. The push-button switch device for a vehicle according to claim 10, wherein a guide rib is formed integrally with an upper face of the extending portion so as to guide water to the opening, the guide rib projecting toward the second case member side while surrounding from above the switch in a state in which waterproofness is ensured, and the extending portion being inclined so as to be positioned lower in going away from the mounting portion.

12. The push-button switch device for a vehicle according to claim 11, wherein a guide rib peripheral guide groove extending along the guide rib while adjoining the guide rib from above is formed on the upper face of the extending portion.

13. The push-button switch device for a vehicle according to claim 4, wherein a cover part covering from the outside the opening formed in the extending portion is formed on the second case member.

14. The push-button switch device for a vehicle according to claim 5, wherein a cover part covering from the outside the opening formed in the extending portion is formed on the second case member.

15. The push-button switch device for a vehicle according to claim 10, wherein a cover part covering from the outside the opening formed in the extending portion is formed on the second case member.

16. The push-button switch device for a vehicle according to claim 11, wherein a cover part covering from the outside the opening formed in the extending portion is formed on the second case member.

17. The push-button switch device for a vehicle according to claim 12, wherein a cover part covering from the outside the opening formed in the extending portion is formed on the second case member.

18. The push-button switch device for a vehicle according to claim 10, wherein the push-button is supported on the case so as to form a housing chamber in cooperation with the case, the switch being housed in and fixed to the housing chamber, an air vent hole providing communication between an interior of the housing chamber and an exterior thereof is provided in the case, and a canopy part covering the air vent hole at least from above is projectingly provided on an outer face of the case so as to guide water from above the air vent hole to below the air vent hole.

19. The push-button switch device for a vehicle according to claim 18, wherein the canopy part has a U-shaped form opening downward so as to surround the air vent hole from above and from the sides.

20. The push-button switch device for a vehicle according to claim 19, wherein a canopy part peripheral guide groove extending along the canopy part while adjoining the canopy part from above is formed on an outer face of the case.

* * * * *